US011559877B2

(12) United States Patent
Chigira et al.

(10) Patent No.: US 11,559,877 B2
(45) Date of Patent: Jan. 24, 2023

(54) STAPLE REMOVING DEVICE

(71) Applicant: MAX CO., LTD., Tokyo (JP)

(72) Inventors: Yoshio Chigira, Tokyo (JP); Toshiyuki Takahashi, Tokyo (JP); Nobuaki Yagi, Tokyo (JP); Kazuya Igata, Tokyo (JP); Katsuya Hakozaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 17/387,398

(22) Filed: Jul. 28, 2021

(65) Prior Publication Data

US 2022/0032435 A1 Feb. 3, 2022

(30) Foreign Application Priority Data

Jul. 31, 2020 (JP) ..... JP2020-131157

(51) Int. Cl.
*B25C 11/00* (2006.01)

(52) U.S. Cl.
CPC ..... *B25C 11/00* (2013.01)

(58) Field of Classification Search
CPC ..... B25C 11/00
See application file for complete search history.

(56) References Cited

U.S. PATENT DOCUMENTS

2017/0173817 A1 6/2017 Shimizu et al.

FOREIGN PATENT DOCUMENTS

| | | | |
|---|---|---|---|
| EP | 3881973 | A1 | 9/2021 |
| JP | 2007-186299 | A | 7/2007 |
| JP | 2017-114678 | A | 6/2017 |
| JP | 2020-078844 | A | 5/2020 |

OTHER PUBLICATIONS

Machine Translation of Chiaki. JP-2017114678-A. "Stapler, Post-Processing Device, and Image Formation System". (Year: 2017).*
Extended European Search Report for EP Application No. 21188103.2 dated Dec. 1, 2021 (6 pp).

* cited by examiner

*Primary Examiner* — Nirvana Deonauth
(74) *Attorney, Agent, or Firm* — Weihrouch IP

(57) ABSTRACT

A staple removing device includes a device body, a removing part provided in the device body and configured to execute a staple removing operation of removing a staple from a sheet bundle, an accommodation unit detachably mounted to the device body and configured to accommodate the staple removed by the removing part, a count unit configured to count a number of operation times of the staple removing operation, a detection unit configured to detect whether the accommodation unit is attached or detached with respect to the device body, a measurement unit configured to measure an elapsed time after the detection unit detects that the accommodation unit is removed from the device body, and an operation-times reset unit that resets the number of operation times when the elapsed time becomes a predetermined time or longer.

11 Claims, 6 Drawing Sheets

STAPLE REMOVING DEVICE

CROSS-REFERENCE TO RELATED APPLICATIONS

The present application claims priority from Japanese Patent Application No. 2020-131157 filed on Jul. 31, 2020, the entire content of which is incorporated herein by reference.

TECHNICAL FIELD

The present disclosure relates to a staple removing device.

BACKGROUND ART

In the related art, known is a staple removing device configured to remove a staple from a sheet bundle. The staple removing device is provided with an accommodation unit for accommodating staples (hereinafter, also referred to as "staple wastes") removed from the sheet bundle.

When the staple wastes in the accommodation unit are in a full or nearly full state, if a staple removing operation is continuously performed with leaving this, as it is, the staple wastes may be clogged or may overflow from the accommodation unit and may be scattered in a device body. For this reason, when the staple wastes in the accommodation unit are in the full or nearly full state, the staple removing operation is prohibited to disable the further staple removing operation, in some cases. Then, when the staple wastes are removed from the accommodation unit and the accommodation unit is empty, the prohibition is reversed so that the staple removing operation can be again performed.

In order to prohibit the staple removing operation according to an amount of the staple wastes in the accommodation unit or to reverse the prohibition, it is necessary to perceive an amount of the staple wastes in the accommodation unit. Here, as a method of perceiving the amount of the staple wastes in the accommodation unit, it is considered a method of once resetting the number of operation times of the staple removing operation in a state where the accommodation unit is empty (a state where there are no staple wastes in the accommodation unit), and then counting the number of operation times of the staple removing operation to perceive an amount (number) of the staple wastes in the accommodation unit. However, according to this method, although it is possible to perceive an amount of increase in staple wastes from the state where the accommodation unit is empty, it is not possible to perceive a decrease of the staple wastes in the accommodation unit, for example, a state where the accommodation unit is empty.

Note that, as for a stapler configured to bind a sheet bundle with a staple, although it is not a staple removing device, suggested is a technology of detecting an amount of staple chips (staple chips that are generated when cutting a staple into an appropriate length during binding processing) accommodated in an accommodation unit by an optical sensor (JP-A-2017-114678 and JP-A-2007-186299).

Like the technology disclosed in JP-A-2017-114678 and JP-A-2007-186299, by detecting the amount of the staple wastes in the accommodation unit with the sensor, it is possible to perceive the decrease of the staple wastes in the accommodation unit (for example, whether the accommodation unit is empty), which cannot be perceived by the number of operation times. However, the sensor is used, so that the cost increases. In addition, since it is necessary to secure a space for arranging the sensor in the device body, the device body increases in size.

SUMMARY OF INVENTION

It is therefore an object of the present disclosure to provide a staple removing device capable of determining whether staple wastes in an accommodation unit are emptied, without using a sensor, and reversing prohibition of a staple removing operation (resetting the number of operation times of the staple removing operation) when it is determined that the staple wastes are emptied.

According to an aspect of the present invention, there is provided a staple removing device including a device body, a removing part provided in the device body and configured to execute a staple removing operation of removing a staple from a sheet bundle, an accommodation unit detachably mounted to the device body and configured to accommodate the staple removed by the removing part, a count unit configured to count a number of operation times of the staple removing operation, a detection unit configured to detect whether the accommodation unit is attached or detached with respect to the device body, a measurement unit configured to measure an elapsed time after the detection unit detects that the accommodation unit is removed from the device body, and an operation-times reset unit that resets the number of operation times when the elapsed time becomes a predetermined time or longer.

According to the present disclosure, when the accommodation unit is removed from the device body for a predetermined time, it is determined that staple wastes in an accommodation unit are discarded and emptied, and the number of operation times is reset. In this way, it is determined that staple wastes in an accommodation unit are emptied, without using a sensor, and the number of operation times is reset. Therefore, it is possible to suppress the increase in cost and the increase in size of the device, which are caused when a sensor is mounted.

DESCRIPTION OF EMBODIMENTS

Hereinafter, favorable embodiments of the present disclosure will be described in detail with reference to the accompanying drawings.

[Configuration Example of Staple Removing Device 10A]

Figure 1A:
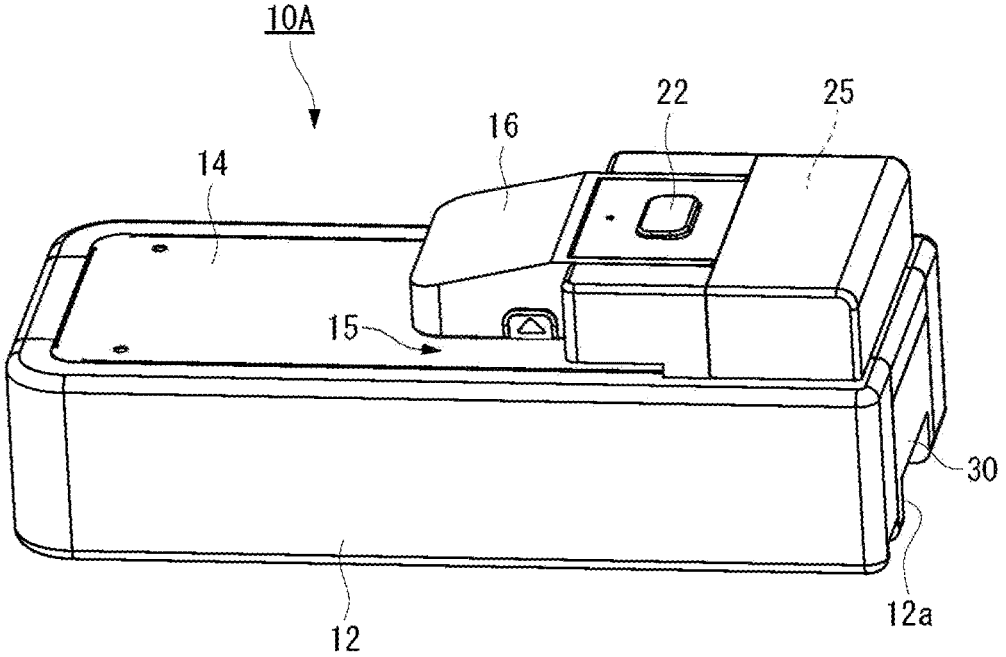
FIG. 1A is a perspective view of a staple removing device according to the present embodiment.
Figure 1B:
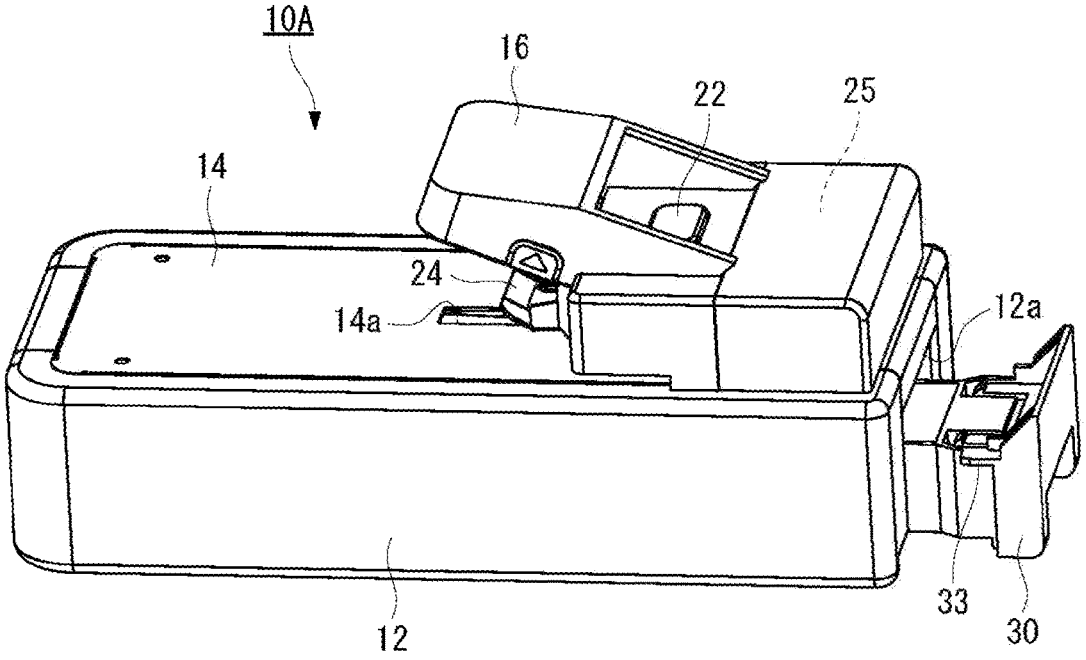
FIG. 1B is a perspective view of the staple removing device, showing a state where an accommodation unit is partially pulled out from a device body and a cover part is raised upward with respect to FIG. 1A.
Figure 2A:
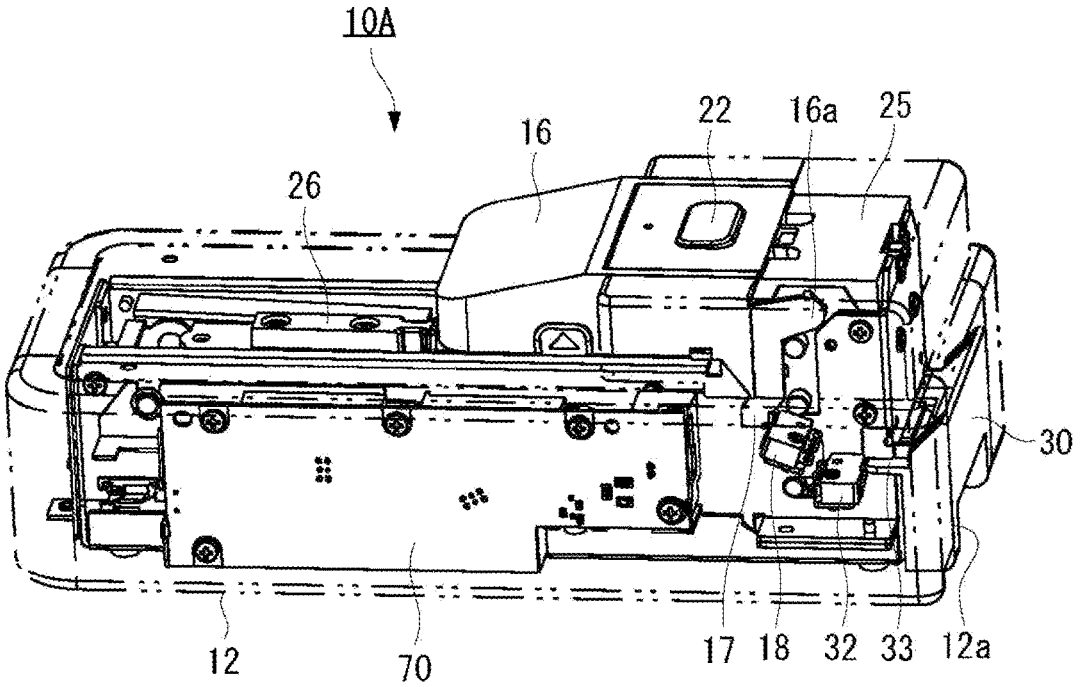
FIG. 2A is a perspective view showing an internal configuration of the staple removing device according to the present embodiment.
Figure 2B:
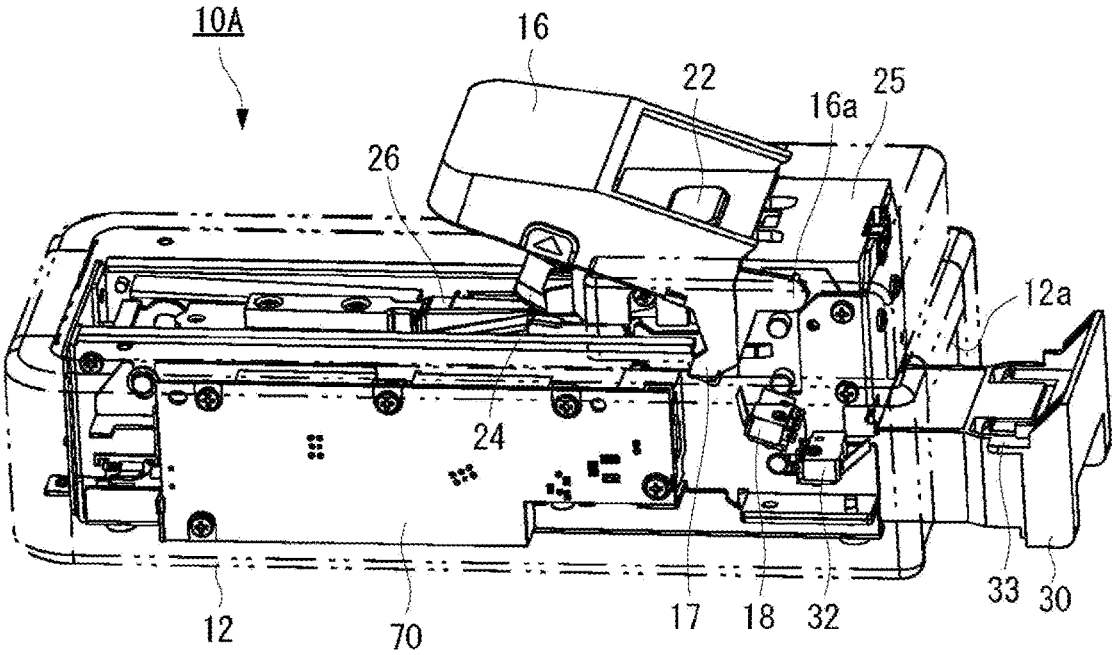
FIG. 2B is a perspective view showing the internal configuration of the staple removing device, showing a state where the accommodation unit is partially pulled out from the device body and the cover part is raised upward with respect to FIG. 2A.

FIG. 1A is a perspective view of a staple removing device 10A according to the present embodiment, and FIG. 1B is a perspective view of the staple removing device 10A, showing a state where an accommodation unit 30 is partially pulled out from a device body 12 and a cover part 16 is raised upward (opened) with respect to FIG. 1A. FIG. 2A is a perspective view showing an internal configuration of the staple removing device 10A, and FIG. 2B is a perspective view showing the internal configuration of the staple removing device 10A, showing a state where the accommodation unit 30 is partially pulled out from the device body 12 and the cover part 16 is raised upward with respect to FIG. 2A. Note that, in the present embodiment, a side on which the accommodation unit 30 is provided, in a length direction of the device body 12, is referred to as a rear side of the staple removing device 10A and an opposite side is referred to as a front side of the staple removing device 10A. In a width direction of the device body 12 (a direction (longitudinal direction) from a lower side toward an upper side or from an upper side toward a lower side of the drawing sheet), a side on which the cover part 16 is provided is referred to as an upper side of the staple removing device 10A and an opposite side is referred to as a lower side of the staple removing device 10A.

The staple removing device 10A is a device for automatically removing (pulling out) a staple from a sheet bundle bound with the staple. As shown in FIGS. 1A to 2B, the staple removing device 10A has the device body 12 constituted by a substantially cuboid housing, a removing part 26 provided in the device body 12 and configured to execute a staple removing operation of removing a staple from the sheet bundle, and an accommodation unit 30 detachably provided to the device body 12 and configured to accommodate the staple removed by the removing part 26. The staple removing device 10A also has a second detection unit 18 configured to detect opening and closing of the cover part 16 with respect to the device body 12, and a first detection unit (detection unit) 32 configured to detect attachment and detachment of the accommodation unit 30 with respect to the device body 12.

As shown in FIGS. 1A and 1B, an upper surface of the device body 12 is provided with a placement surface 14 on which a sheet bundle bound with the staple having a crown portion and leg portions can be placed. The sheet bundle is placed on the placement surface 14 so that the crown portion becomes a lower side (placement surface 14-side). The cover part 16 configured to cover a part of the placement surface 14 is provided above the placement surface 14, and a part of the placement surface 14 located below the cover part 16 is formed with an opening portion 14*a* through which a portion of the removing part 26 can protrude.

In the cover part 16, a pressing plate 24 for pressing the sheet bundle placed on the placement surface 14 is provided. A pressing mechanism 25 for driving the pressing plate 24 is provided at an upper part of the device body 12 and behind the pressing plate 24. The pressing plate 24 is configured to be movable toward and away from the placement surface 14 by the pressing mechanism 25, and to move toward the placement surface 14 to press the sheet bundle on the placement surface 14.

A sheet bundle insertion/pullout opening 15 having a predetermined gap is formed between the cover part 16 and the placement surface 14. The sheet bundle is inserted (set) in the sheet bundle insertion/pullout opening 15. An upper surface of the cover part 16 is provided with an activation part 22 that can be operated by an operator and is provided to start a staple removing operation. The activation part 22 is constituted, for example, by a push button switch that can be turned on and off by an operator's pressing operation. Note that, the activation part 22 is not limited to the push button switch, and may be a rotary switch, a rocker switch, a toggle switch, or the like.

The cover part 16 is configured so that a rear end portion 16*a* is supported by a shaft part (not shown) provided to the pressing mechanism 25 and a tip end portion can move toward and away from the placement surface 14 about the rear end portion 16*a* as a fulcrum. In other words, the cover part 16 is configured to be movable between a close position in which the opening portion 14*a* and the pressing plate 24 are covered and an open position in which the opening portion 14*a* and the pressing plate 24 are exposed.

As shown in FIG. 2A and the like, a second operation part 17 for turning on and off the second detection unit 18 according to the opening and closing operation of the cover part 16 is provided below the rear end portion 16*a* of the cover part 16. Note that, the second operation part 17 is not limited to the shape and arrangement shown in FIG. 2A as long as it can turn on and off the second detection unit 18.

The second detection unit 18 is an interlock switch, and is configured to be on by being pushed by the second operation part 17 when the cover part 16 is located in the close position and to be off by separating from the second operation part 17 when the cover part 16 is located in the open position. In the present embodiment, when the second detection unit 18 is not on, i.e., the cover part 16 is not located in the close position, the staple removing operation cannot be started.

The removing part 26 is arranged below the placement surface 14, and includes a wedge-shaped plate member for removing a staple from the sheet bundle. The removing part 26 is configured to be movable along the placement surface 14. When the removing part 26 is moved by a predetermined distance, a part thereof protrudes from the opening portion 14*a* of the placement surface 14 and is further moved (advanced) while maintaining the protruding state. Since the staple part of the sheet bundle is set on the placement surface 14 so as to be located above the opening portion 14*a* (so as to face the opening portion 14*a*), when the removing part 26 is advanced with protruding from the opening portion 14*a*, the removing part 26 is inserted between the sheet bundle and the crown portion of the staple, and therefore, can pull out the staple from the sheet bundle.

The accommodation unit 30 is located on the rear side of the device body 12 and below the opening portion 14*a*, i.e., below the staple part of the sheet bundle. For this reason, the staple pulled out from the sheet bundle by the removing part 26 is dropped into the accommodation unit 30, as it is. The accommodation unit 30 is detachably attached to the device body 12 and is inserted and pulled out through an opening 12*a* formed in a rear end face of the device body 12.

A first operation part 33 for turning on and off the first detection unit 32 according to the attaching and detaching operation of the cover part 30 with respect to the device body 12 is provided at a rear left part of the accommodation unit 30. Note that, the first operation part 33 is not limited to the shape and arrangement shown in FIG. 2A as long as it can turn on and off the first detection unit 32.

The first detection unit 32 is an interlock switch, and is configured to be on by being pushed by the first operation part 33 when the accommodation unit 30 is mounted to the device body 12 and to be off by separating from the first operation part 33 when the accommodation unit 30 is removed from the device body 12. In the present embodiment, when the first detection unit 32 is not on, i.e., the accommodation unit 30 is not mounted to the device body 12, the staple removing operation cannot be started.

A substrate 70 on which a regulator 42, a control unit 50, a drive circuit 60 and the like, which will be described later, are mounted is arranged at a left part inside the device body 12. Note that, the substrate 70 may also be arranged at a part other than the left part inside the device body 12.

[Example of Hardware Configuration of Staple Removing Device 10A]

Figure 3:
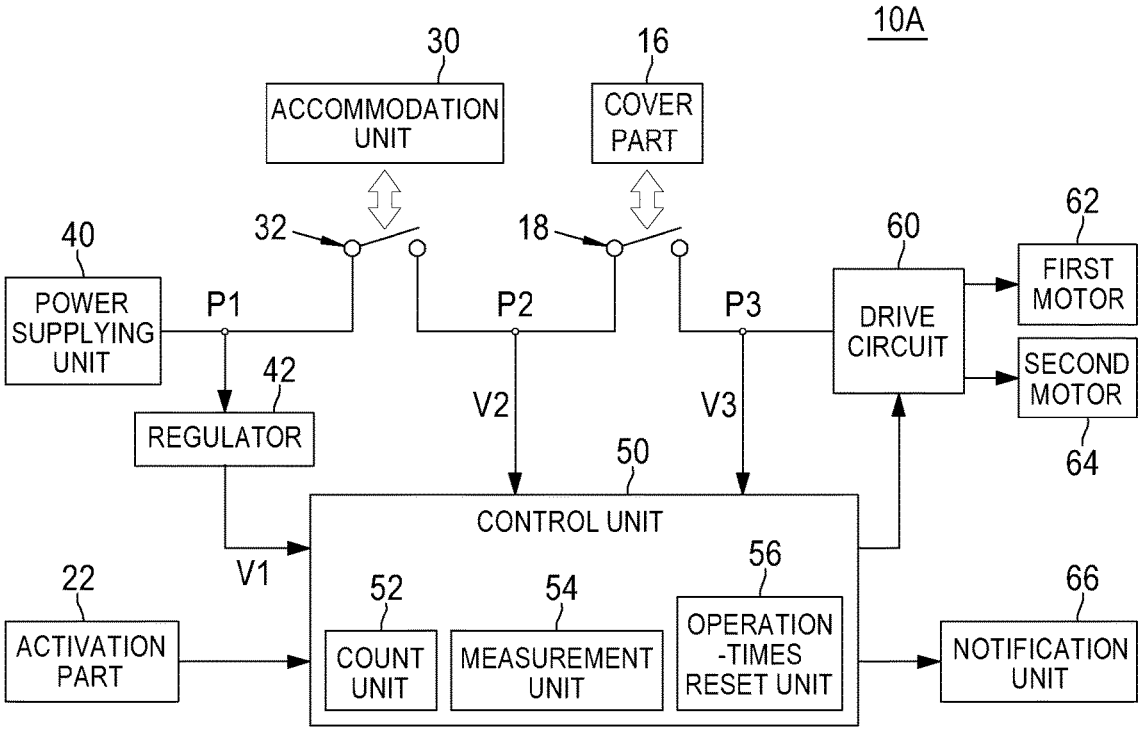
FIG. 3 is a block view showing a hardware configuration of the staple removing device according to the present embodiment.

FIG. 3 is a block view showing a hardware configuration of the staple removing device 10A according to the present embodiment.

As shown in FIG. 3, the staple removing device 10A has a power supplying unit 40, the first detection unit 32, the second detection unit 18, a regulator 42, a control unit 50, a drive circuit 60, a first motor 62, and a second motor 64. The staple removing device 10A also has the activation part 22 and a notification unit 66.

The power supplying unit 40 includes, for example, an AC adapter and a power supply cord, and is connected to one contact point of the first detection unit 32 and the regulator 42 via a branch point P1. The power supplying unit 40 is configured to convert AC power supplied from an outlet to DC power, for example. In the present embodiment, the power supplying unit 40 converts 100V of an AC voltage to 24V of a DC voltage.

The regulator 42 is configured to convert the DC voltage (for example, 24C) converted by the power supplying unit 40 into a drive voltage V1 (for example, 5V) for actuating the control unit 50. The drive voltage V1 converted by the regulator 42 is supplied to the control unit 50.

The first detection unit 32 is connected to the control unit 50 and one contact point of the second detection unit 18 via a branch point P2. The first detection unit 32 becomes on when the accommodation unit 30 is attached to the device body 12. When the first detection unit 32 becomes on, the power supplying unit 40 and the control unit 50 are electrically connected and a DC voltage V2 from the power supplying unit 50 is supplied to the control unit 50. When the accommodation unit 30 is removed from the device body 50, the first detection unit 32 becomes off, so that the power supplying unit 40 and the control unit 50 are not electrically connected and the DC voltage V2 is not supplied to the control unit 50.

The second detection unit 18 is connected at the other contact point to the control unit 50 and the drive circuit 60 via a branch point P3. When the cover part 16 is in the close position, the second detection unit 18 becomes on, so that the power supplying unit 40 and the control unit 50 are electrically connected and a DC voltage V3 from the power supplying unit 40 is supplied to the control unit 50. When the cover part 16 is in the open position, the second detection unit 18 becomes off, so that the power supplying unit 40 and the control unit 50 are not electrically connected and the DC voltage V3 is not supplied to the control unit 50.

The control unit 50 includes a CPU (Central Processing Unit), a ROM (Read Only Memory), a RAM (Random access memory) and the like, and is configured to drive based on the drive voltage V1 supplied from the regulator 42 and to control each unit by executing a program stored in the memory such as a ROM and the like.

The control unit 50 includes a count unit 52 configured to count the number of operation times of the staple removing operation, a measurement unit 54 configured to measure an elapsed time after the first detection unit 32 becomes off, i.e., after the accommodation unit 30 has been removed from the device body 12, and an operation-times reset unit 56 configured to reset the number of operation times at a time when the elapsed time becomes a predetermined time (hereinafter, also referred to as "reference elapsed time β"). The respective functions of the count unit 52, the measurement unit 54 and the operation-times reset unit 56 are implemented by the control unit 50. Note that, the number of operation times is maintained in a non-volatile memory.

The control unit 50 is configured to perform control of starting (executing) the staple removing operation at a time when the DC voltage V2 is supplied via the first detection unit 32, the DC voltage V3 is supplied via the second detection unit 18 and the activation part 22 is operated.

When the first detection unit 32 and the second detection unit 18 become on and the activation part 22 becomes on, the drive circuit 60 drives the first motor 62 or the second motor 64, in response to a command from the control unit. Note that, the drive circuit 60 may be constituted by an inverter circuit having a plurality of switching elements.

The first motor 62 is a motor for driving the removing part 26, and is arranged inside the device body 12. The first motor 62 is configured to drive based on the AC power supplied from the drive circuit 60, thereby moving the removing part 26 in the front and rear direction along the placement surface 14. For the first motor 62, a DC brush motor may be used, for example.

The second motor 64 is a motor for driving the pressing mechanism 25, and is arranged inside the device body 12. The second motor 64 is configured to drive based on the AC power supplied from the drive circuit 60, thereby moving the pressing plate 24 toward or away from the placement surface 14. For the second motor 64, a DC brush motor may be used, for example.

The notification unit 66 is constituted by a light-emitting unit such as an LED (Light Emitting Diode), an output unit configured to output a buzzer sound or voice, a display unit configured to display characters and the like, or the like, and is controlled by the control unit 50. The notification unit 66 executes notification when the accommodation unit 30 is removed from the device body 12, for example. In addition, the notification unit 66 may execute notification after the accommodation unit 30 is removed from the device body 12 until the accommodation unit 30 is again attached to the device body 12 or may execute notification when the number of operation times of the staple removing operation reaches a predetermined number of times or after the number of operation times of the staple removing operation reaches a predetermined number of times until the number of operation times is reset. Note that, when the notification unit 66 is constituted by the LED or the like, the lighting thereof may be controlled in a lighting pattern of blinking, lighting, lights-out and the like, according to the attachment and detachment state of the accommodation unit 30 with respect to the device body 12.

[Operation Example of Staple Removing Device 10A]

Figure 4:
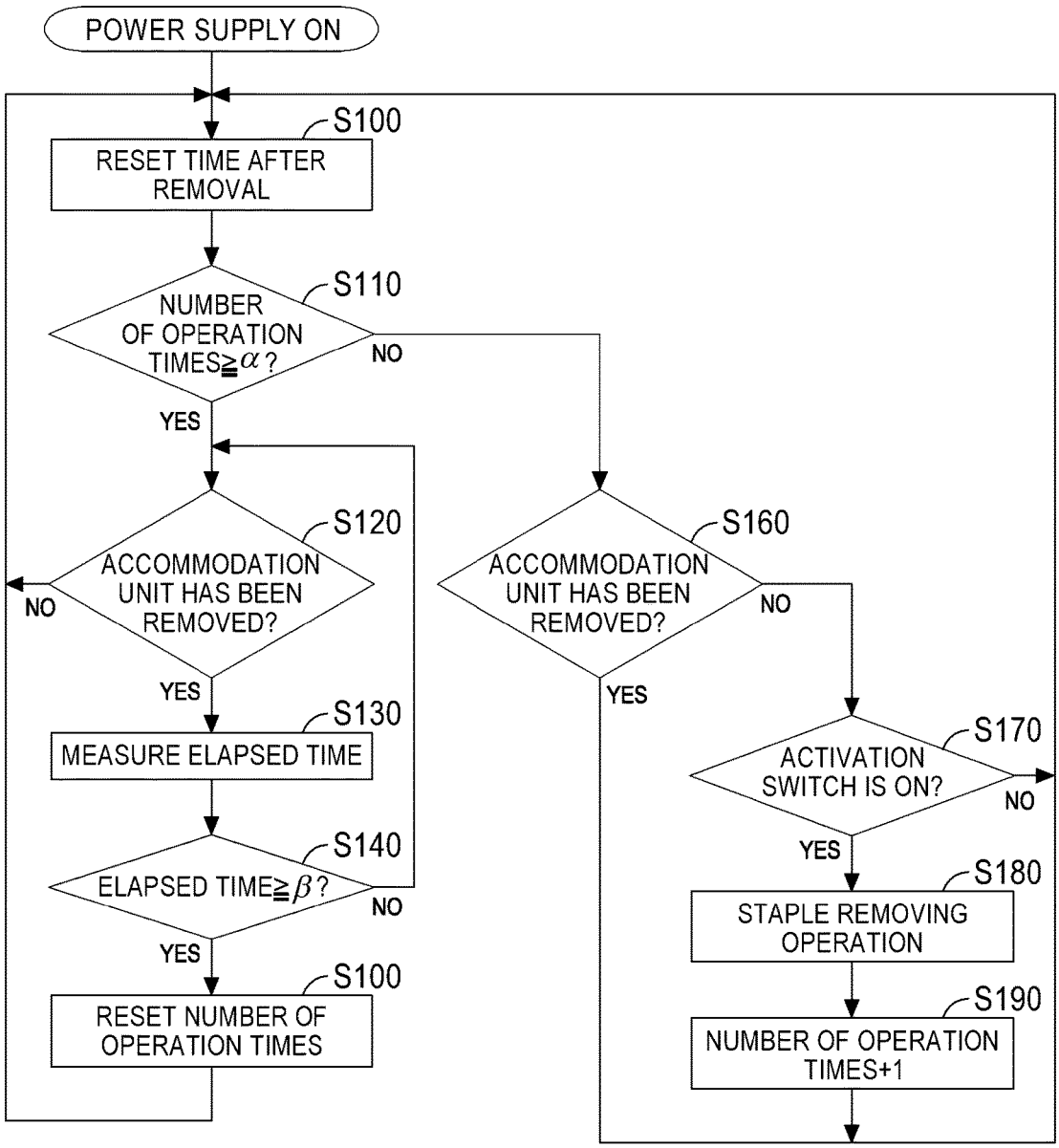
FIG. 4 is a flowchart showing a staple removing operation of the staple removing device according to the present embodiment.

FIG. 4 is a flowchart showing the staple removing operation of the staple removing device 10A according to the present embodiment.

When the power supply of the staple removing device 10A becomes on, the elapsed time after the accommodation unit 30 has been removed from the device body 12 is reset (to 0) in step S100. At this time (when the power supply becomes on), the number of operation times of the staple removing operation holds the previous state (the number of operation times at a time when the power supply was off in the previous time).

In step S110, it is determined whether the number of operation times of the staple removing operation is equal to or larger than a preset reference number of operation times (predetermined number of times) a. The count of the number of operation times is associated with the number of times that the activation part 22 becomes on (the count value of the number of operation times is added (incremented) by 1 each time the activation part 22 is once pressed). However, the present disclosure is not limited thereto.

When it is determined in step S110 that the number of operation times of the staple removing operation becomes equal to or larger than the reference number of operation times α, the process proceeds to step S120, in which it is determined whether the accommodation unit 30 has been removed from the device body 12. Whether the accommodation unit 30 has been removed from the device body 12 is determined whether the first detection unit 32 is off Note that, the control unit 50 may control the removing part 26 so as not to start the staple removing operation even though the activation part 22 is operated, after the number of operation times reaches the reference number of operation times α until the number of operation times is reset in step S150, which will be described later. When the number of operation times of the staple removing operation reaches the reference number of operation times a, the notification by the notification unit 66 may be executed to notify the operator of the fact. For example, in a case where the notification unit 66 is constituted by an LED, the LED may be turned on or blinked.

When it is determined in step S120 that the accommodation unit 30 has been removed from the device body 12, i.e., when the first detection unit 32 is off, the process proceeds to step S130, in which time is measured by the measurement unit 54. Also, the control unit 50 may control the removing part 26 so as not to start the staple removing operation even though the activation part 22 is operated, after it is determined that the accommodation unit 30 has been removed from the device body 12 until the accommodation unit 30 is again attached to the device body 12. On the other hand, when it is determined that the accommodation unit 30 has not been removed from the device body 12, i.e., when the accommodation unit 30 is attached to the device body 12 and the first detection unit 32 is on, the process returns to step S100.

In step S140, it is determined whether the elapsed time measured by the measurement unit 54 is equal to or longer than a preset reference elapsed time (predetermined time) β. When it is determined that the elapsed time is equal to or longer than the reference elapsed time β, the process proceeds to step S150, in which it is determined that staple wastes in the accommodation unit 30 are emptied, and the number of operation times are rest (to 0). On the other hand, when it is determined that the elapsed time is shorter than the reference elapsed time β, the process returns to step S120. Note that, when the number of operation times is reset, the process returns to step S100, and the above processing is repeatedly executed.

On the other hand, when it is determined in step S110 that the number of operation times of the staple removing operation is less than the reference number of operation times α, the process proceeds to step S160, in which it is determined whether the accommodation unit 30 has been removed from the device body 12, i.e., whether the first detection unit 32 is off.

When it is determined in step S160 that the accommodation unit 30 has been removed from the device body 12, i.e., the first detection unit 32 is off, the process returns to step S100. On the other hand, when it is determined that the accommodation unit 30 is attached to the device body 12, the process proceeds to step S170. When the accommodation unit 30 has been removed from the device body 12, the notification by the notification unit 66 may be executed to notify the operator of the fact.

In step S170, it is determined whether the activation part 22 becomes on by the operator. When it is determined that the activation part 22 becomes on, the process proceeds to step S180, in which the staple removing operation is started. Specifically, the first motor 62 and the second motor 64 are driven to start the staple removing operation. Thereby, the staple removing operation is once executed, so that the staple is pulled out from the sheet bundle placed on the placement surface 14 and the pulled-out staple is accommodated in the accommodation unit 30. On the other hand, when it is determined in step S170 that the activation part 22 is not on, the process returns to step S100.

In step S190, when the staple removing operation is once executed, the count unit 52 adds (increments) 1 to the count value of the number of operation times of the staple removing operation. When the addition of the count value of the number of operation times is over, the process returns to step S100.

Here, the reference number of operation times α is set within a range from a half or larger of a maximum amount (maximum number of accommodation) of the staple wastes that can be accommodated in the accommodation unit 30 and to the maximum number of accommodation or smaller. For example, when it is assumed that the number of staple wastes, which can be accommodated in the accommodation unit 30, is 1,000 (when the staple wastes are 1,000, the accommodation unit 30 is in a full state), the reference number of operation times a is set within a range from 500 times (equivalent to 500) or larger, which is a half of 1,000 times equivalent to the maximum number of accommodation of 1,000, to 1,000 times or smaller. The reason why the reference number of operation times α is set to the half or larger of the maximum number of accommodation is a result of setting a safety width (margin) relatively large. For example, the margin may be set smaller, for example, to 60% (600 times, in the above example) of the maximum number of accommodation or 70% (700 times, in the above example) of the maximum number of accommodation. On the other hand, when the reference number of operation times a is set smaller (for example, 300 times, in the above example), the frequency to remove the staple wastes from the accommodation unit 30 (i.e., to empty the accommodation unit 30) increases, which burdens the operator. Note that, the reference number of operation times α may be arbitrarily selected and set via an input unit (not shown) by the operator.

The reference elapsed time β means a time for which it is considered that the operator pulls out the accommodation unit 30 from the device body 12 and then removes (discards) the staple wastes from the accommodation unit 30. However, the present inventors repeatedly reviewed, validated, tested and investigated the reference elapsed time β. As a result, it was found that the time (reference elapsed time β) to remove (discard) staple wastes after removing the accommodation unit 30 from the device body 12 is about 2 seconds (2000 ms) or longer (preferably, 3 seconds or longer, and more preferably, 4 seconds or longer). In other words, it is very difficult to perform a series of operations of removing the accommodation unit 30 from the device body 12 and emptying the accommodation unit 30, for a time period less than 2 seconds. Note that, the predetermined time may be arbitrarily selected and set via an input unit (not shown) by the operator.

As described above, according to the present embodiment, when the number of operation times of the staple removing operation becomes equal to or larger than the reference elapsed time α and the elapsed time after the accommodation unit 30 has been removed from the device body 12 becomes equal to or longer than the reference elapsed time β, it is determined that staple wastes in the accommodation unit 30 are emptied, and the number of operation times is reset. Specifically, when the number of operation times becomes the reference number of operation times α, it is determined that a predetermined amount (a staples) of staple wastes is collected in the accommodation unit 30 and it is time to discard the staple wastes. Thereafter, when the accommodation unit 30 is removed from the device body 12 for the predetermined time (reference elapsed time β), it is determined that staple wastes are discarded from the accommodation unit 30 and the accommodation unit 30 is thus empty. In this way, since it is possible to know the amount of staple wastes in the accommodation unit 30 by monitoring the number of operation times of the staple removing operation, it is possible to determine when to discard the staple wastes. In addition, when the accommodation unit 30 is removed from the device body 12 for the predetermined time in the state (at a time to discard staple wastes), it can be determined that the staple wastes have been discarded from the accommodation unit 30. Note that, if the notification unit 66 is configured to notify that it is time to further discard staple wastes, so as to urge the operator to discard the staple wastes, a possibility that staple wastes will be discarded from the accommodation unit 30 is increased, as compared to a case where the notification is not executed. However, it should be noted that the notification for urging discard of staple wastes is not essential to the present invention.

In the present embodiment, when the number of operation times reaches the reference number of operation times a and the elapsed time becomes the reference elapsed time β, it is determined that the accommodation unit 30 is empty. However, it may also be determined that the accommodation unit 30 is empty, based on only the elapsed time for which the accommodation unit 30 is removed, without determining the number of operation times. The reason is that, when the accommodation unit 30 is removed for a predetermined time, there is a high possibility that staple wastes in the accommodation unit 30 will be discarded.

First Modified Embodiment

Figure 5:
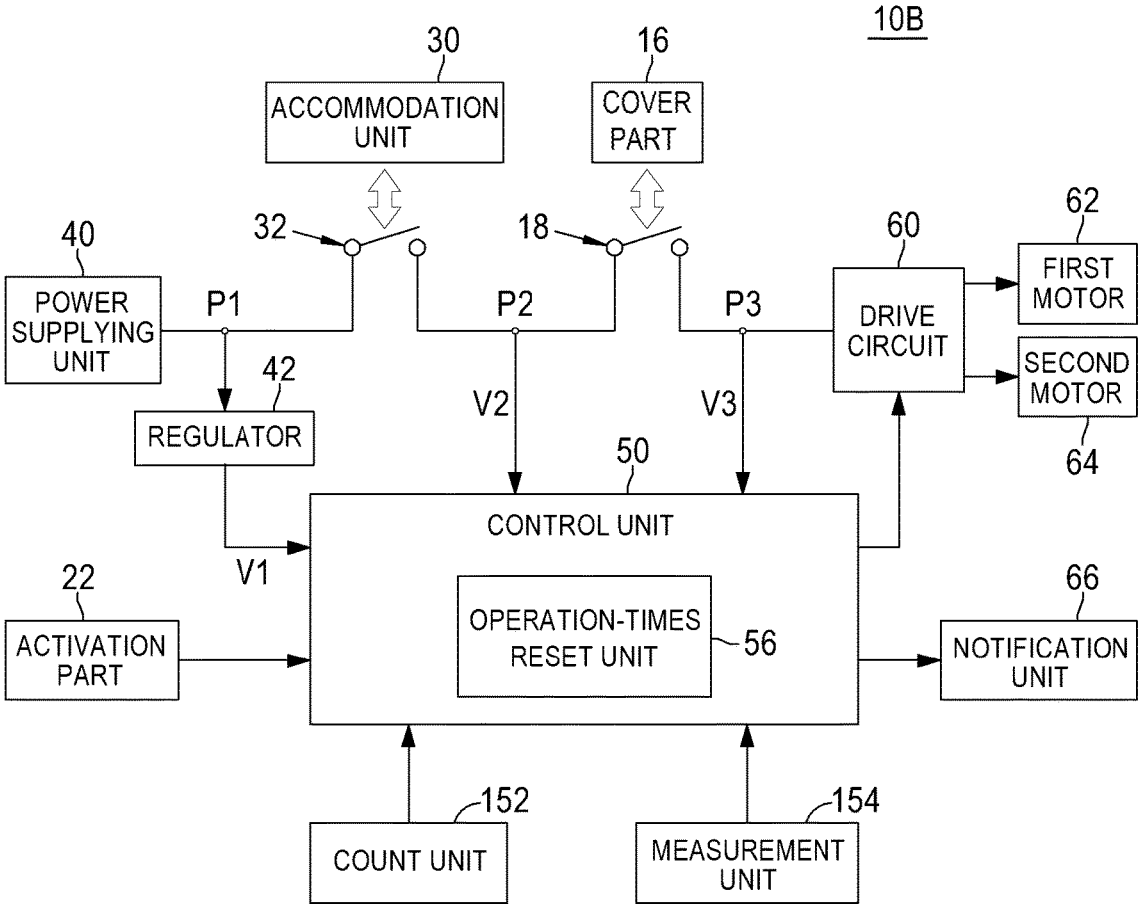
FIG. 5 is a block view showing a hardware configuration of a staple removing device according to a first modified embodiment.

FIG. 5 is a block view showing a hardware configuration of a staple removing device 10B according to a first modified embodiment. Note that, the constitutional elements that are substantially the same as the staple removing device 10A of the above embodiment are denoted with the same reference signs, and the descriptions thereof are omitted. Since the staple removing operation is also common to the staple removing operation of the staple removing device 10A shown in FIG. 4, the detailed descriptions thereof are omitted.

In the staple removing device 10A according to the above embodiment, in the control unit 50, the count of the number of operation times of the staple removing operation and the measurement of time for which the accommodation unit 30 is removed are performed in a software manner by the program. However, in a staple removing device 10B according to a first modified embodiment, a count unit (counter) 152 for counting the number of operation times and a measurement unit (timer) 154 for measuring elapsed time are provided separately from the control unit 50. Therefore, the control unit 50 is configured to import a count value (number of operation times) from the count unit 152 and a measured value (elapsed time) from the measurement unit 154, and to perform the control shown in FIG. 4 based on the imported values.

Second Modified Embodiment

Figure 6:
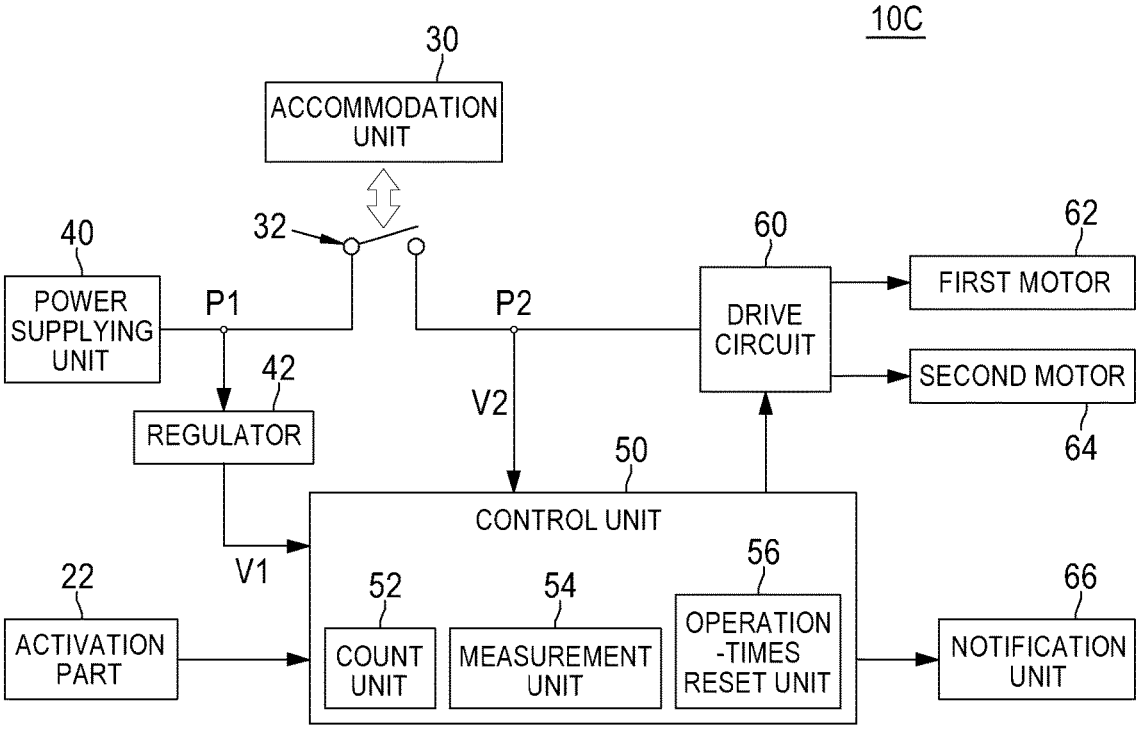
FIG. 6 is a block view showing a hardware configuration of a staple removing device according to a second modified embodiment.

FIG. 6 is a block view showing a hardware configuration of a staple removing device 10C according to a second modified embodiment. Note that, the constitutional elements that are substantially the same as the staple removing device 10A of the above embodiment are denoted with the same reference signs, and the descriptions thereof are omitted.

In the above embodiment, the interlock mechanism is constituted by the two switches of the first detection unit 32 and the second detection unit 18. However, in a second modified embodiment, the interlock mechanism is constituted by one switch of the first detection unit 32.

According to the second modified embodiment, since the interlock mechanism is constituted by one switch of the first detection unit 32, it is possible to save the cost and the space, as compared to the configuration where the interlock mechanism is constituted by a plurality of, for example, two switches. In addition, since the interlock mechanism is constituted only by the first detection unit 32, it is possible to simplify a circuit configuration.

Although the favorable embodiments of the present disclosure have been described in detail with reference to the accompanying drawings, the technical scope of the present disclosure is not limited thereto. The technical spirit that can lead to a variety of changes or modifications within the technical spirit defined in the claims by one skilled in the art of the present disclosure is included within the technical scope of the present disclosure.

What is claimed is:

1. A staple removing device comprising:

a device body;

a removing part provided in the device body and configured to execute a staple removing operation of removing a staple from a sheet bundle, the removing part including a plate member that is inserted between the sheet bundle and a crown portion of the staple;

an accommodation unit detachably mounted to the device body and configured to accommodate the staple removed by the removing part, the accommodation unit including a receptacle which is inserted and pulled out through an opening formed in the device body;

a processor configured to control the removing part; and a detection unit configured to detect whether the accommodation unit is attached or detached with respect to the device body, the detection unit including a switch, wherein:

the processor or a counter counts a number of operation times of the staple removing operation, the processor or a timer measures an elapsed time after the detection unit detects that the accommodation unit is removed from the device body; and the processor resets the number of operation times when the elapsed time becomes a predetermined time or longer.

2. The staple removing device according to claim 1, wherein the processor is configured to reset the number of operation times when the elapsed time becomes a predetermined time or longer after the number of operation times reaches a predetermined number of times.

3. The staple removing device according to claim 1, further comprising an activation part configured to be operated by an operator, the activation part including a further switch, wherein the processor starts the staple removing operation when the activation part is operated, and is configured to control the removing part so as not to start the staple removing operation even though the activation part is operated after the detection unit detects that the accommodation unit is removed from the device body until the detection unit detects that the accommodation unit is attached to the device body.

4. The staple removing device according to claim 1, further comprising an activation part configured to be operated by an operator, the activation part including a further switch, wherein the processor starts the staple removing operation when the activation part is operated, and is configured to control the removing part so as not to start the staple removing operation even though the activation part is operated after the number of operation times reaches the predetermined number of times until the number of operation times is reset.

5. The staple removing device according to claim 3, wherein the processor is configured to control the removing part so as not to start the staple removing operation even though the activation part is operated after the number of operation times reaches the predetermined number of times until the number of operation times is reset.

6. The staple removing device according to claim 1, further comprising a notification unit, wherein the processor is configured to control the notification unit to execute notification at a time when it is detected that the accommodation unit is removed from the device body, the notification unit including at least one of a display, an LED, and a sound indicator.

7. The staple removing device according to claim 6, wherein the processor is configured to control the notification unit to execute notification after it is detected that the accommodation unit is removed from the device body until it is detected that the accommodation unit is attached to the device body.

8. The staple removing device according to claim 1, further comprising a notification unit, the notification unit including at least one of a display, an LED, and a sound indicator, wherein the processor is configured to control the notification unit to execute notification at a time when the number of operation times reaches the predetermined number of times.

9. The staple removing device according to claim 8, wherein the processor is configured to control the removing part so as to control the notification unit to execute notification after the number of operation times reaches the predetermined number of times until the number of operation times is reset.

10. The staple removing device according to claim 1, wherein the predetermined time is 2 seconds or longer.

11. The staple removing device according to claim 2, wherein the predetermined number of times is equal to or larger than a half of a maximum staple capacity of the accommodation unit.

* * * * *